US009698546B2

(12) United States Patent
Daughtry

(10) Patent No.: US 9,698,546 B2
(45) Date of Patent: Jul. 4, 2017

(54) BLIND-MATE CONNECTOR HAVING SIDEWALLS WITH NOTCHES FOR ALIGNMENT

(71) Applicant: Genesis Technology USA, Inc., Lawrenceville, GA (US)

(72) Inventor: Earl Anthony Daughtry, Lawrenceville, GA (US)

(73) Assignee: Genesis Technology USA, Inc., Lawrenceville, GA (US)

( * ) Notice: Subject to any disclaimer, the term of this patent is extended or adjusted under 35 U.S.C. 154(b) by 0 days.

(21) Appl. No.: 15/225,921

(22) Filed: Aug. 2, 2016

(65) Prior Publication Data

US 2017/0063002 A1 Mar. 2, 2017

Related U.S. Application Data

(60) Provisional application No. 62/209,633, filed on Aug. 25, 2015.

(51) Int. Cl.

| | |
|---|---|
| ***H01R 13/64*** | (2006.01) |
| ***H01R 24/50*** | (2011.01) |
| ***H01R 12/70*** | (2011.01) |
| ***H01R 12/72*** | (2011.01) |
| *H01R 103/00* | (2006.01) |
| *H01R 43/20* | (2006.01) |

(52) U.S. Cl.

CPC ..... *H01R 24/50* (2013.01); *H01R 12/7005* (2013.01); *H01R 12/722* (2013.01); *H01R 43/205* (2013.01); *H01R 2103/00* (2013.01)

(58) Field of Classification Search

CPC .... H01R 9/0515; H01R 12/724; H01R 24/50; H01R 12/7005; H01R 12/91; H01R 13/6315; H01R 13/64; H01R 13/642

USPC ..... 439/581, 246–252, 325, 374, 680

See application file for complete search history.

(56) References Cited

U.S. PATENT DOCUMENTS

| | | | | | |
|---|---|---|---|---|---|
| 4,964,805 | A * | 10/1990 | Gabany | H01R 24/50 | 439/434 |
| 5,404,117 | A * | 4/1995 | Walz | H01P 5/085 | 333/260 |
| 5,532,659 | A * | 7/1996 | Dodart | H01R 9/0515 | 333/260 |
| 5,921,793 | A * | 7/1999 | Phillips | H01R 24/44 | 439/188 |
| 6,065,976 | A * | 5/2000 | Wang | H01R 24/50 | 439/581 |

(Continued)

*Primary Examiner* — Chandrika Prasad

(74) *Attorney, Agent, or Firm* — Lee & Hayes, PLLC; Charles L. Warner

(57) ABSTRACT

A blind-mate connector (10, 20, 100) has a barrel (11, 21, 105), a base (12, 22, 110) at the back end of the barrel, an insulator (17, 27) mounted in the base, and a center conductor (15, 25) extending from near the front end of the barrel, through the insulator, and extending beyond the back end of the base, with the center conductor being held by the insulator. One type has sidewalls (13, 23) extending rearwardly from the back end of the base, and alignment notches (14, 24) on the sidewalls, the alignment notches extending only partially from the back ends of the sidewalls toward the base. Another type has alignment tabs (125) extending rearwardly from the back end, and sidewalls (130) extending rearwardly from the back end of the base, the first tab being above the first sidewall.

13 Claims, 10 Drawing Sheets

(56) References Cited

U.S. PATENT DOCUMENTS

| | | | | |
|---|---|---|---|---|
| 6,238,218 | B1 * | 5/2001 | Baffert | H01R 24/50<br>439/581 |
| 7,540,771 | B2 * | 6/2009 | Lee | H01R 24/50<br>439/581 |

* cited by examiner

BLIND-MATE CONNECTOR HAVING SIDEWALLS WITH NOTCHES FOR ALIGNMENT

CROSS-REFERENCE TO RELATED APPLICATION

This application claims the priority of U.S. Provisional Patent Application No. 62/209,633, filed Aug. 25, 2015, entitled "INDEXED EDGE MOUNT CONNECTOR," the entire disclosure and contents of which are incorporated herein by reference.

SUMMARY

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure. In addition, it is not necessary to use all techniques described herein in order to obtain any benefit or benefits described herein. Also, it is not necessary to obtain all benefits described herein in order to obtain any benefit described herein. In other words, one can choose to obtain only one benefit described, or to obtain more than one of the benefits described herein, and can choose to implement a design that provides the chosen benefit(s) and to not implement other designs described herein.

Blind-mate connectors are described herein which are compatible with automated blind-mating processes, thereby simplifying, accelerating, and/or reducing the cost of, the automated joinder of printed circuit boards, and reducing or eliminating damage and/or loss by the automated process due to misaligned connectors. The blind-mate connectors described herein are particularly beneficial when there are two or more connectors on each of the printed circuit boards to be joined together.

One blind-mate connector, as described herein, has: a barrel having a front end and a back end; a base at the back end of the barrel, the base having a front end and back end; a first sidewall extending rearwardly from the back end of the base on a first side, and having a front end at the back end of the base, a back end, and first alignment notch, the first alignment notch extending only partially from the back end of the first sidewall toward the base; a second sidewall extending rearwardly from the back end of the base on a second side, and having a front end at the back end of the base, a back end, and a second alignment notch, the second alignment notch extending only partially from the back end of the second sidewall toward the base; an insulator mounted in the base; and a center conductor extending from near the front end of the barrel, through the insulator, and extending beyond the back end of the base, the center conductor being held by the insulator.

Another blind-mate connector, as described herein, has: a barrel having a front end and a back end; a base at the back end of the barrel, the base having a front end and back end; a first tab extending rearwardly from the back end of the base on a first side; a second tab extending rearwardly from the back end of the base on a second side; a first sidewall extending rearwardly from the back end of the base at a first corner, the first tab being above the first sidewall; a second sidewall extending rearwardly from the back end of the base at a second corner, the second tab being above the second sidewall; an insulator mounted in the base; and a center conductor extending from near the front end of the barrel, through the insulator, and extending beyond the back end of the base, the center conductor being held by the insulator.

Another blind-mate connector, as described herein, has: an insulated body having a front end and a back end; a first sidewall extending rearwardly from the back end of the body on a first side, and having a front end at the back end of the body, a back end, and a first alignment notch, the first alignment notch extending only partially from the back end of the first sidewall toward the body; a second sidewall extending rearwardly from the back end of the body on a second side, and having a front end at the back end of the body, a back end, and a second alignment notch, the second alignment notch extending only partially from the back end of the second sidewall toward the body; an insulated tongue mounted in the base; and a plurality of electrical contacts on the insulated tongue.

Another blind-mate connector, as described herein, has: an insulated body having a front end and a back end; a first tab extending rearwardly from the back end on a first side; a second tab extending rearwardly from the back end on a second side; a first sidewall extending rearwardly from the back end at a first corner, the first tab being above the first sidewall; a second sidewall extending rearwardly from the back end at a second corner, the second tab being above the second sidewall; an insulated tongue mounted in the base; and a plurality of electrical contacts on the insulated tongue.

The blind-mate connectors described herein may be plugs or may be receptacles.

The barrel of a blind-mate connector may be threaded or not threaded.

The barrel, base, sidewalls, any tabs of a blind-mate connector may be unitary.

The barrel, base, sidewalls, and any tabs of a blind-mate connector may be made of a conductive material.

The body, sidewalls, and any tabs of a blind-mate connector may be unitary.

The body, sidewalls, and any tabs of a blind-mate connector may be made of an insulative material.

DESCRIPTION

Figure 1:
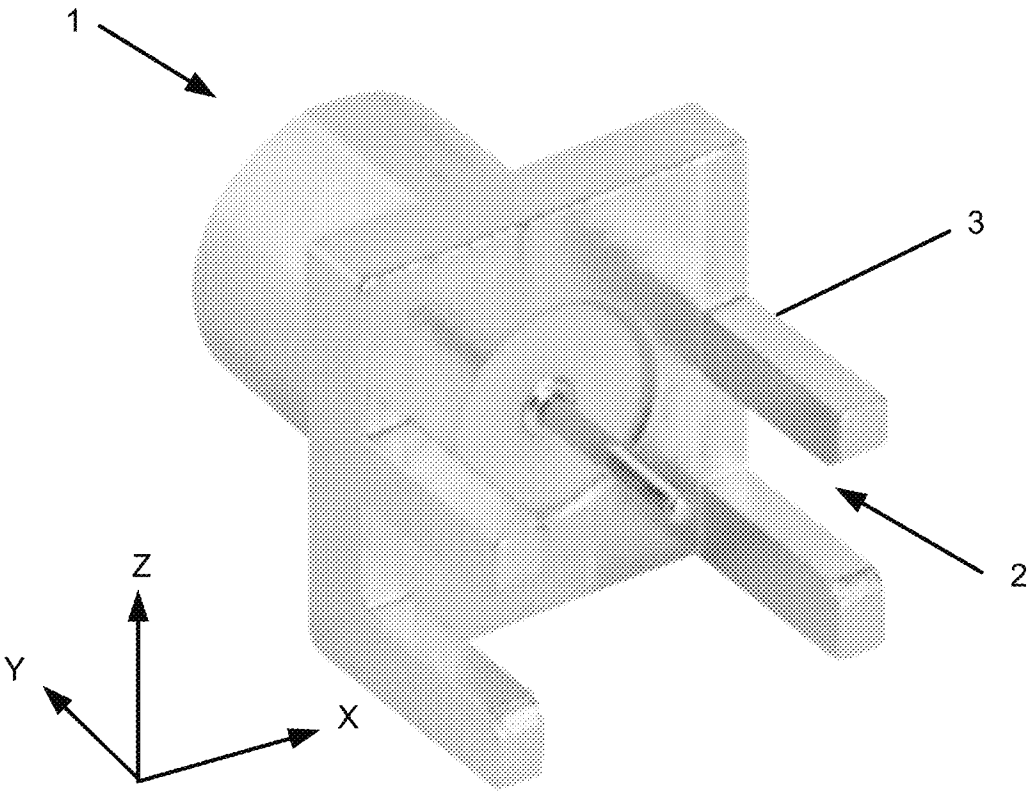
FIG. 1 is an illustration of a conventional edge mount connector having tabs or posts for mounting the connector to a printed circuit board (PCB).

For the benefit of increasing readability, by reducing the recitation and repetition of inclusive terms, the terms "may be, but is not limited to," "can be, but is not limited to," "by way of example, and not of limitation," "such as, but not limited to," "for example, and not as a limitation," and similar inclusive expressions, are abbreviated herein as "may be," "can be," "by way of example," "such as," and "for example."

For convenience of discussion herein, when there is more than one of a component, that component may be referred to herein either collectively or singularly by the singular reference numeral unless the context indicates otherwise. For example, components "N" (plural) or component "N" (singular) may be used unless a specific component is intended.

Edge mount connectors, sometimes referred to as "edge-launch" connectors, have been pervasive in RF coaxial engineering assemblies for many years. FIG. 1 is an illustration of a conventional edge mount connector 1 having tabs or posts 3 for mounting the connector 1 to a printed circuit board (PCB) (not shown in FIG. 1). The gap 2 between the posts 3 is sized to at least accommodate the thickness of a PCB and therefore somewhat aligns the connector 1 on the PCB vertically (the "Z"-dimension). The posts 3 do not, however, serve to align the connector 1 on the PCB either laterally ("X"-dimension) or in depth ("Y"-dimension). Thus, the drawback to this class of coaxial mounted connectors is the inability to accurately control positioning of a connector. A problem with such conventional edge-launch connectors is that they may not line up properly. Then, when the PCBs on which they are mounted are pushed toward each other, such as is done by machine, called "blind mating," the result may be that the connectors do not mate, or that one or both of the connectors and/or to one or both of the PCBs is damaged.

Conventional blind-mate edge mount connectors partially address this problem. They have self-aligning features which can compensate for small misalignment errors and allow the connectors to be mated by a machine. Common methods of blind mating rely upon on an external mechanical guide for alignment, or rely on the use of a generous lead-in section and/or conical tapering mechanism to accommodate the misalignment. Blind-mate edge mount connectors are mated or joined by a sliding or snapping action which can be accomplished without wrenches or other tools, and are often used in radio frequency (RF) and optical applications. In some cases, however, the misalignment may be greater than can be accommodated by the blind-mate connectors, so blind-mating cannot be performed, especially when performed by a machine. In addition, if multiple edge mount connectors are to be mated, i.e., there are two or more connectors on each PCB, then each connector must be closely aligned with its corresponding connector for blind-mating to occur.

Figure 2:
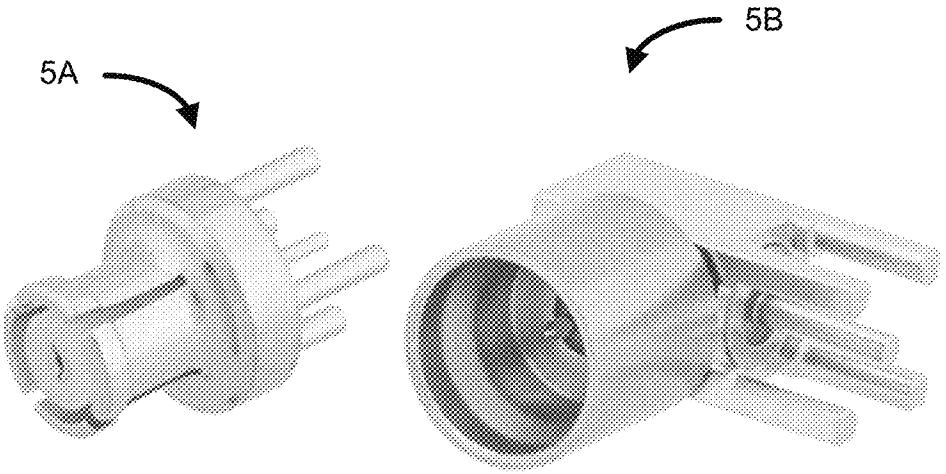
FIG. 2 is an illustration of two conventional blind-mate connectors which can accommodate a limited degree of misalignment.

FIG. 2 is an illustration of two conventional blind-mate connectors 5A, 5B, which can accommodate a limited degree of misalignment. In many instances, however, the range of expected position tolerances of the connectors on PCBs is larger than can be accommodated by conventional blind-mate connectors. Therefore, a custom lead-in section and/or conical tapering mechanism may be used with the blind-mate connectors. This custom section or mechanism may, however, alter the mechanical and/or electrical characteristics of the connectors beyond the standards set forth in the applicable connector specification, thus causing other problems, such as physical interference with other components, use of excessive space, signal loss, signal reflections, signal leakage, etc.

Figure 3:
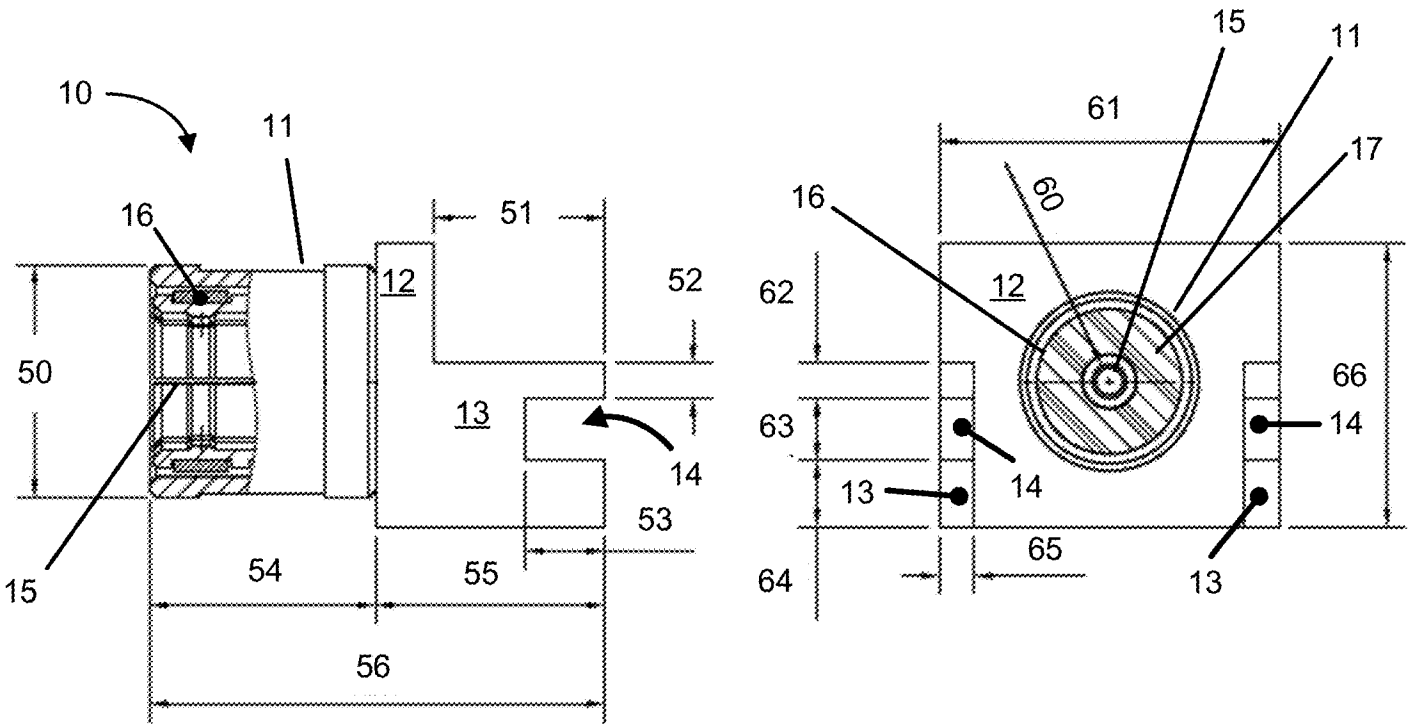
FIG. 3 illustrates an exemplary blind-mate connector to be edge-mounted on a PCB.
Figure 4:
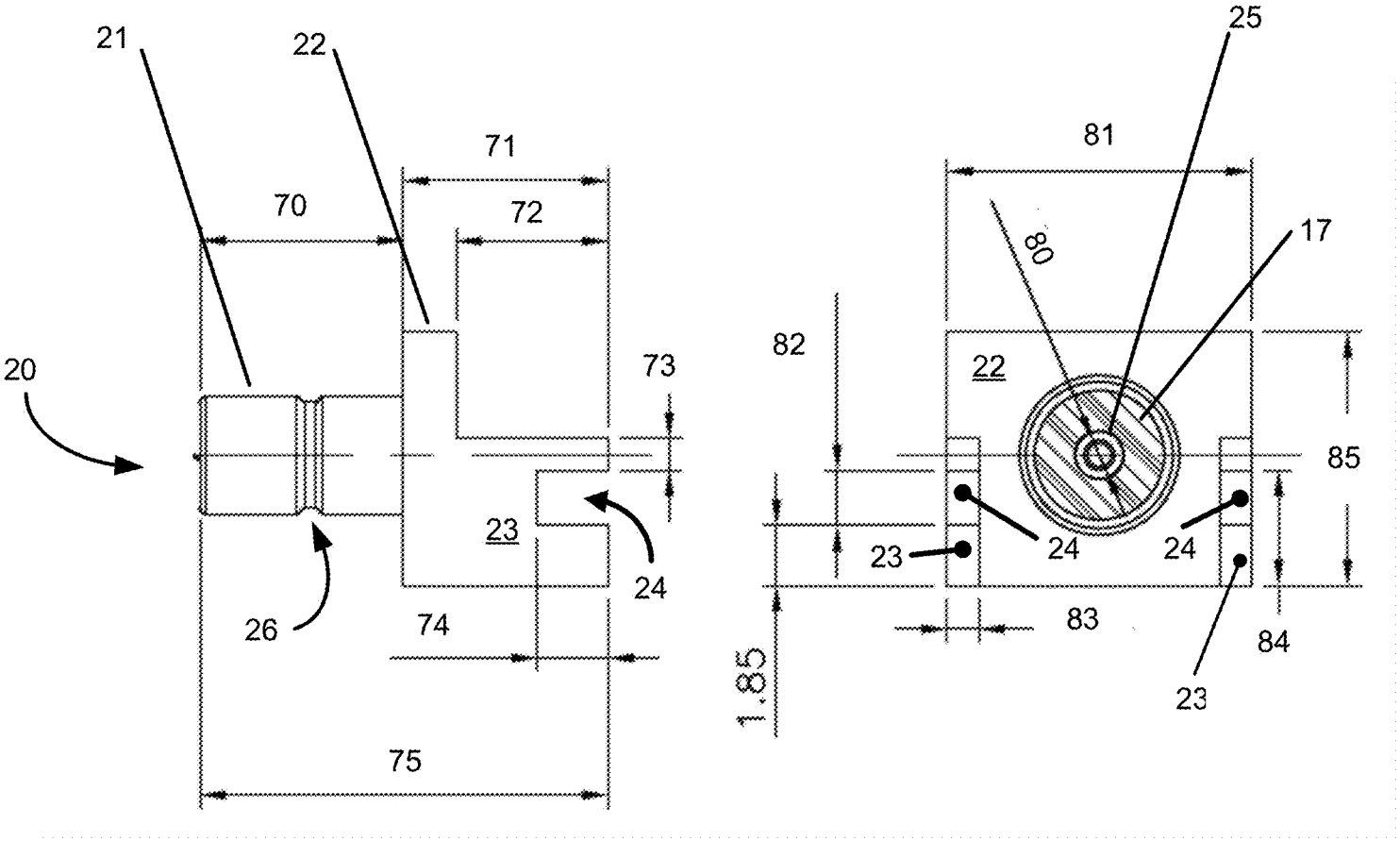
FIG. 4 illustrates another exemplary blind-mate connector to be edge-mounted on a PCB.
Figure 5:
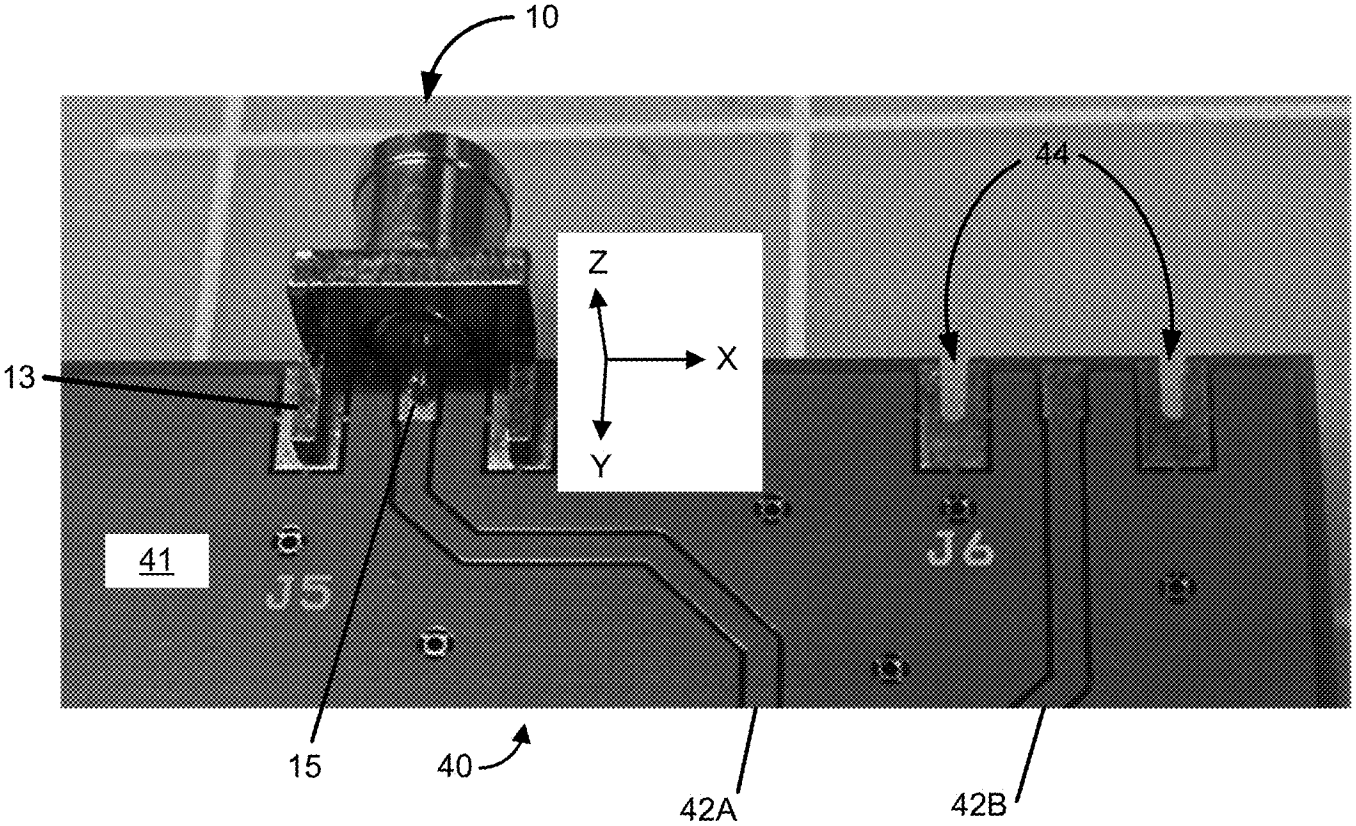
FIG. 5 illustrates a PCB having an exemplary blind-mate connector mounted thereon.

FIG. 3 illustrates an exemplary blind-mate connector 10 to be edge-mounted on a PCB 40 (FIG. 5). The illustrated connector 10 is a plug, and has a barrel 11, a base 12 at the back end of the barrel 11, an insulator 17 mounted in the base 12, and a center conductor 15. The center conductor 15 extends from near the front end of the barrel 11, through the connector 10, through the insulator 17, to the rear of the connector 10. The insulator 17 holds the center conductor 15 in position. The center conductor 15 is a center pin. There may also be a retaining ring 16 mounted in the barrel 11 and configured to accept and releasably retain a receptacle (also called a "jack") (for example, as in FIG. 4) inserted into the barrel 11. The construction and appearance of the front part of the connector 10 is therefore similar to the construction and appearance of a conventional connector. The construction and appearance of the rear part of the connector 10, however, is different from the construction and appearance of a conventional connector, as described below.

The illustrated connector 10 also has sidewalls 13, and an alignment notch 14 (also called a "notch") in each sidewall 13. The sidewalls 13 extend rearwardly from the back end of the base 12. An alignment notch 14 extends from the back end of the sidewall 13 toward the base 12, but does not extend all the way to the base 12. An alignment notch 14 has a height 63, which is approximately the thickness of the printed circuit board on which the blind-mate receptacle is to be mounted, and a depth 53. Preferably, but not necessarily, the barrel 11, the base 12, and the sidewalls 13 are formed as a unitary structure manufactured from a conductive material, such as brass. The center conductor 15 is made of a conductive material, such as beryllium copper. The retaining ring 16 is made of a conductive material, such as beryllium copper. The insulator 17 is made of a nonconductive material, such as Teflon®. The illustrated exemplary connector 10 is a SubMiniature Version B (SMB) plug. Other types of connectors may also be manufactured or used in accordance with the drawing and this specification. Exemplary dimensions are provided in Table I below.

FIG. 4 illustrates another exemplary blind-mate connector 20 to be edge-mounted on a PCB 40 (FIG. 5). The illustrated connector 20 is a receptacle, and has a barrel 21, a base 22 at the back end of the barrel 21, an insulator 27 mounted in the base 22, and a center conductor 25. The connector 20 also has an indent or retaining groove 26 which mates with the retaining ring 16 of connector 10 to releasably join the connectors 10 and 20 together when they are mated. The insulator 27 holds the center conductor 25 in position. The center conductor 15 is a center contact configured to accept the center pin 15 of a plug (for example, plug 10 as in FIG. 3) when the connectors 10 and 20 are mated. The construction and appearance of the front part of the connector 20 is therefore similar to the construction and appearance of a conventional connector. The construction and appearance of the rear part of the connector 20, however, is different from the construction and appearance of a conventional connector, as described below.

The illustrated connector 20 also sidewalls 23, and an alignment notch 24 in each sidewall 23. The sidewalls 23 extend rearwardly from the back end of the base 22. An alignment notch 24 extends from the back end of the sidewall 23 toward the base 22, but does not extend all the way to the base 22. Preferably, but not necessarily, the barrel 21, the base 22, and the sidewalls 23 are formed as a unitary structure manufactured from a conductive material, such as brass. The center conductor 25 is made of a conductive material, such as brass. The connector 20 also has an insulator 27 made of a nonconductive material, such as Teflon®. The illustrated exemplary connector 20 is a Sub-Miniature Version B (SMB) jack. Other types of connectors may also be manufactured or used in accordance with the drawing and this specification. Exemplary dimensions are provided in Table I below.

FIG. 5 illustrates a PCB 40 having an exemplary blind-mate connector 10 mounted thereon. The PCB 40 has a ground plane 41 and conductors 42A, 42B. Conductor 42A is shown as being soldered to the backside of the center conductor 15 (center pin) of connector 10. The ground plane 41 is shown as being soldered to the sidewalls 13 of connector 10. It should be noted that a notch 14 of the connector 10 does not merely mate with an edge of the PCB 40. Rather, a notch 14 of the connector 10 mates with a slot 44 of the PCB 40. Similarly, a notch 24 of a connector 20 does not merely mate with an edge of the PCB 40. Rather, a notch 24 of a connector 20 mates with a slot 44 of the PCB 40. This notch-and-slot mating precisely aligns the connector 10 or 20 on the PCB 40.

The precision of the alignment in the "X"-dimension is determined by the width of the sidewall 13 or 23 and the width of the slot 44. The greater the width of a slot 44 as compared with the width of the sidewall 13, then the more play there will be in the "X"-dimension position of the connector 10, 20 on the PCB 40.

Notches 14, 24 and the slots 44 have depths such that the front end of the connector will be at a predetermined distance from the front edge of the PCB on which the connector is mounted. Preferably, the dimensions of the notches and slots are carefully controlled so that the connector 10, 20 will fit tightly and exactly onto the PCB 40 with little or no play, especially in the "X"- and "Z"-dimensions. The connector 10, 20 is pressed inward so that the notches 14, 24 fully engage the slots 44, and the connector 10, 20 is therefore also precisely aligned on the PCB 40 with respect to the "Y"-dimension (depth of insertion).

The precision of the alignment in the "Z"-dimension is determined by the height of the notch 14, 24, and the height (thickness) of the PCB 40. The greater the height of a notch 14, 24 as compared with the height of the PCB, then the more play there will be in the "Z"-dimension position of the connector 10, 20 on the PCB 40. Thus, a notch 14, 24 preferably has a height which is approximately the thickness of the printed circuit board on which the blind-mate connector is to be mounted.

The precision of the alignment is affected by the precision of the machine which routes or forms the slots 44 in the PCB 40, and by the precision of the machine which forms, cuts, or trims the notches 14, 24 into the connectors 10, 20. Current manufacturing techniques provide for precision placement of the slots 44 in the PCB 40 and the notches 14, 24 in the connectors 10, 20 so that, when the notches 14, 24 of the connectors 10, 20 are mated with the slots 44 of the PCB 40, the positions of the connectors 10, 20 on their respective PCBs 40 are within the tolerances allowable for blind mating of the connectors 10, 20 on the PCBs 40. This precise manufacturing of the connectors 10, 20 and the PCBs 40 provides for precise positioning of the connectors 10, 20 on the PCBs 40, and therefore allows for machine positioning and blind mating of two PCBs 40 each having two or more connectors 10, 20 thereon.

Figure 6:
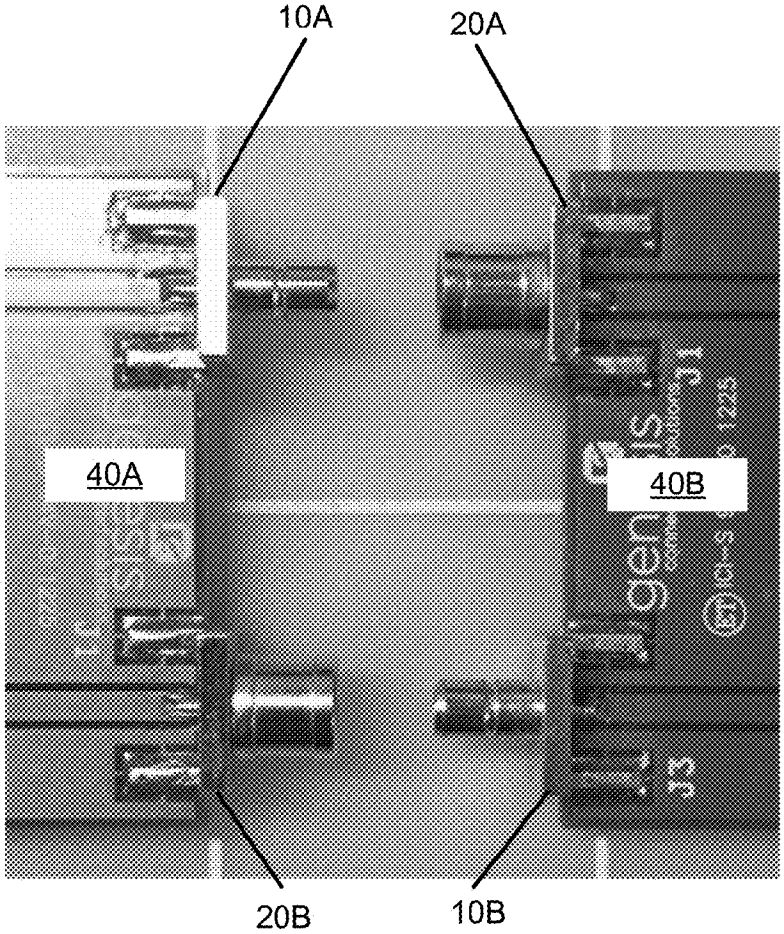
FIG. 6 illustrates a first PCB having connectors thereon positioned to be mated with a second PCB having respective mating connectors thereon.

FIG. 6 illustrates a first PCB 40A, having connectors 10A and 20B thereon, positioned to be mated with a second PCB 40B, having respective mating connectors 20A and 10B thereon. Assume first that the connectors on the PCBs 40 are the conventional edge mount connectors 1, 5A, 5B as in FIGS. 1 and 2. Assume also that the connectors are improperly positioned on the PCBs 40A, 40B, e.g., there is play in the horizontal position of the connectors, for example, the connectors are positioned on PCB 40A slightly to one side of the PCB, toward the bottom of the page as drawn. The connectors will not be lined up, so machine mating of the PCB 40A, 40B will not be possible without some mechanism or person detecting and adjusting the positions of at least one of the PCBs 40 in an attempt to align all of the connectors.

An even worse scenario results from the conventional connectors being misaligned in opposite directions on a PCB 40. For example, assume that one connector on a PCB is a conventional connector and is misaligned slightly toward the top of the page, and that the other connector on that same PCB is also a conventional connector and is misaligned slightly toward the bottom of the page. Shifting the PCB 40A toward the top of the page or the bottom of the page will only result in one pair of conventional connectors being aligned for mating, but the other pair of connectors would not be aligned and could not achieve a mating connection.

Similarly, if one conventional connector is misaligned slightly coming out of the page, and its mating conventional connector is misaligned slightly going into the page, then even shifting the PCB 40A into or out of the page will only result in one pair of conventional connectors being aligned for mating; the other pair of connectors would not be aligned and could not achieve a mating connection.

Thus, in the misalignment scenarios discussed above, one or both of the PCBs 40 will have to be discarded, manually joined if possible, or returned for re-positioning of the connector(s).

Assume now that the connectors 10, 20 are the exemplary edge mount connectors as in FIGS. 3 and 4. The connectors 10A, 10B, 20A, and 20B will be precisely positioned (aligned) on their respective PCBs 40A, 40B by the notches 14, 24 and the slots 44. If the respective PCBs 40 are properly aligned with each other then the connectors 10, 20 will also be properly aligned with each other. The blind-mate connectors 10, 20 are thus easily mated by machine when their respective PCBs 40 are mated. For example, the connectors 10, 20 can be easily mated by a machine (not shown) which simply pushes the PCBs 40 toward each other. Precise positioning of the connectors 10, 20 on the PCBs 40 thus provides for machine blind mating of the connectors 10, 20 based on the alignment of the PCBs 40. The depth of insertion ("Y"-dimension) of the connectors 10, 20 may be controlled by detecting or controlling the position of the PCBs 40, or by detecting that the PCBs 40 have stopped moving even though mating pressure is still being applied.

Figure 7:
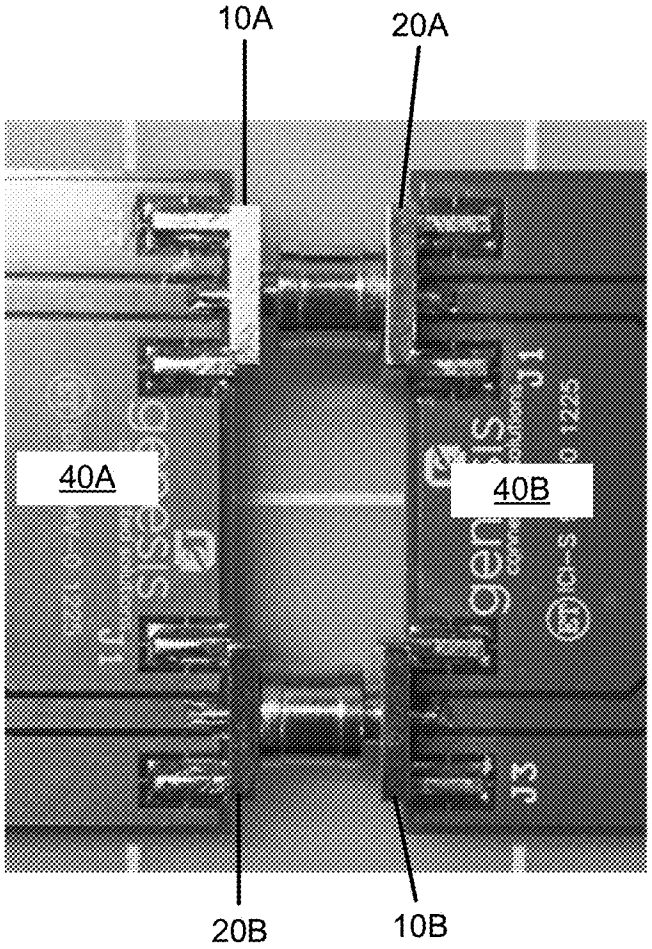
FIG. 7 illustrates the first PCB mated with the second PCB of FIG. 6.

FIG. 7 illustrates the first PCB 40A mated with the second PCB 40B of FIG. 6. More particularly, connectors 10A and 20B are mated with the connectors 20A and 10B, respectively. The notches 14, 24 on the connectors 10, 20, and the slots 44 on the PCBs 40 accurately align the connectors 10, 20 on the PCBs 40, and permit machine mating of PCBs 40 having one or more exemplary blind-mate connectors 10, 20 thereon. Thus, PCBs 40 with multiple RF and/or optical ports may be machine mated.

Although FIGS. 5-7 show provisions for two connectors 10A and 20B, or 10B and 20A, on a PCB 40, this is merely for convenience of illustration. Each PCB 40 may have only a single connector 10 or 20 on it. Conversely, each PCB 40 may have 3, 4, 5, or more connectors 10 and/or 20 on it. Also, even though FIGS. 6 and 7 show a plug 10 and a receptacle 20 on each PCB 40, this is merely for convenience of illustration. A PCB 40 may have only plugs 10, and its mating PCB 40 may have only receptacles 20. Thus, a PCB 40 may have one or more connectors 10, 20; and the connectors 10, 20 on the PCB 40 having two or more connectors 10, 20 may all be plugs 10, may all be receptacles 20, or may be a desired mixture of both plugs 10 and receptacles 20.

Table I below lists the exemplary dimensions for the exemplary connectors 10, 20 of FIGS. 3 and 4.

TABLE I

| REFERENCE | LENGTH OR DISTANCE (MILLIMETERS) | REFERENCE | LENGTH OR DISTANCE (MILLIMETERS) |
|---|---|---|---|
| 50 | 6.5 | 51 | 4.75 |
| 52 | 1.00 | 53 | 2.21 |
| 54 | 6.3 | 55 | 6.40 |
| 56 | 12.7 | | |
| 60 | 0.96 | 61 | 9.50 |
| 62 | 1.00 | 63 | 1.73 |
| 64 | 1.85 | 65 | 0.99 |
| 66 | 7.9 | | |
| 70 | 6.35 | 71 | 6.40 |
| 72 | 4.75 | 73 | 1.00 |
| 74 | 2.21 | 75 | 12.75 |
| 80 | 0.96 | 81 | 9.50 |
| 82 | 1.73 | 83 | 0.99 |
| 84 | 3.58 | 85 | 7.90 |

Even though directed primarily to, and discussed above with respect to, blind-mate connectors, this technique can be used for initial machine mating of connectors which then requires a subsequent action, such as screwing the connectors together.

Figure 8:
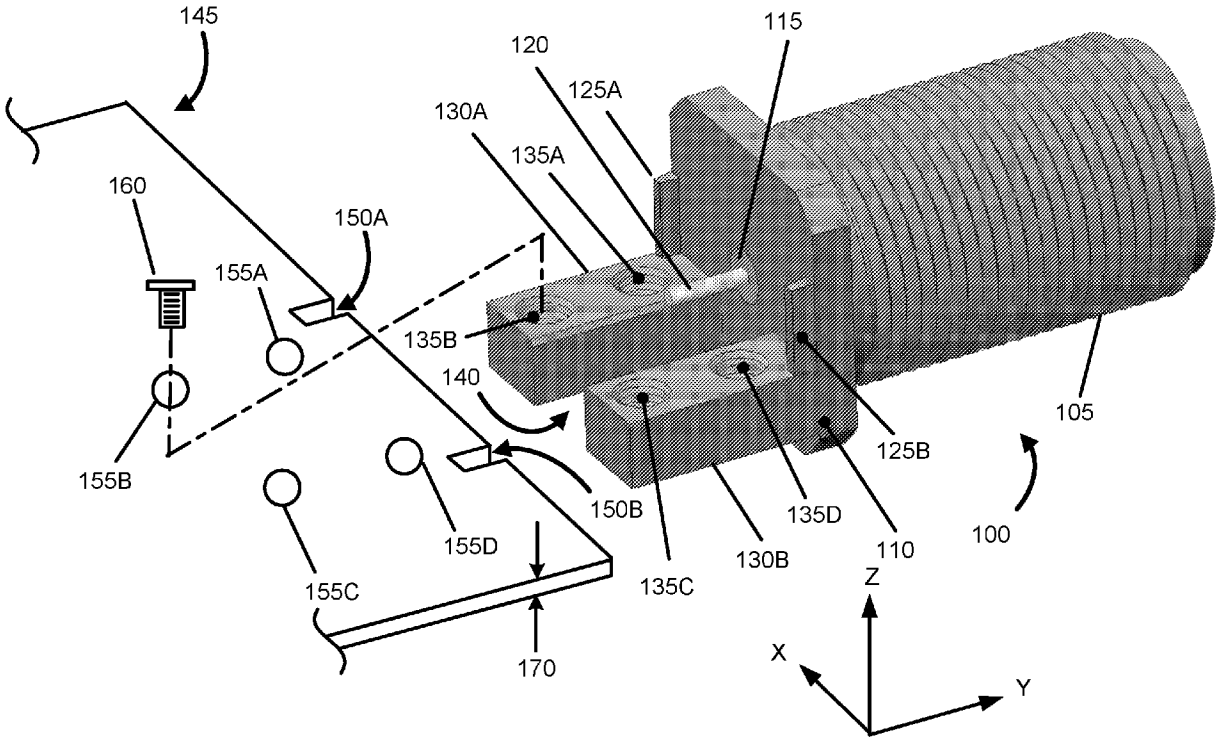
FIG. 8 illustrates another exemplary blind-mate connector to be edge-mounted on a PCB.

FIG. 8 illustrates another exemplary blind-mate connector 100. The connector 100 may be a threaded connector to be edge-mounted on a PCB 145, such as a receptacle or jack, and such as an N-type connector or an SMA-type connector. The illustrated connector 100 is a receptacle and has a threaded barrel 105 configured to accept the threaded cowling of a corresponding mating plug (not shown), a base 110 at one end of the threaded barrel 105, an insulator 115 extending substantially throughout the length of the threaded barrel 105, and a center conductor 120 (center contact) extending substantially throughout the length of the threaded barrel 105 and configured to accept the center conductor (center pin) of the corresponding mating plug.

The connector 100 further comprises tabs 125A, 125B which fit into slots 150A, 150B of the PCB 145. The tabs 125A, 125B and corresponding slots 150A, 150B serve to position the connector 100 laterally ("X"-dimension) on the PCB 145 and can also control the depth of insertion ("Y"-dimension).

The connector 100 further comprises sidewalls 130A, 130B which extend from the base 110 and fit under the PCB 145, which has a thickness 170. The sidewalls 130A, 130B also serve to position the connector 100 vertically ("Z"-dimension) on the PCB 145.

The sidewalls 130A, 130B have holes 135A, 135B, 135C, 135D and the PCB 145 has corresponding holes 155A, 155B, 155C, 155D. The holes 135A, 135B, 135C, 135D are preferably threaded so that screws, such as a screw 160, can be inserted through the holes 155A, 155B, 155C, 155D and screwed into the holes 135A, 135B, 135C, 135D, thereby positioning and firmly attaching the connector 100 to the PCB 145. The holes 135A, 135B, 135C, 135D, 155A, 155B, 155C, 155D serve to fix the position of the connector 100 on the PCB 145 in several directions. The screws and holes can be used to fix the position of the connector 100 on the PCB 145 after, for example, precise placement by machine of the connector 100 on the PCB 145.

A threaded blind-mate connector plug (not shown) to be edge-mounted on a PCB 145, such as an indexed N-type connector, may be similarly constructed, that is, using alignment tabs such as tabs 125A, 125B, and sidewalls such as sidewalls 135A, 135B, with or without holes 135A, 135B, 135C, 135D, 155A, 155B, 155C, 155D.

In an alternative embodiment, the holes 135A, 135B, 135C, 135D, 155A, 155B, 155C, 155D are not used. Rather, the accuracy of the placement of the connector 100 on the PCB 145 in the lateral direction is determined by the width of the tabs 125A, 125B and the width of the slots 150A, 150B. Further, the accuracy of the placement of the connector 100 on the PCB 145 in the depth direction ("Y"-dimension) is determined by the length of the tabs 125A, 125B and the depth of the slots 150A, 150B. The sidewalls 130A, 130B of the connector 100 can be soldered to pads (not shown) on the bottom side of the PCB 145.

The techniques disclosed above are not limited to round or "barrel"-type connectors, they are also applicable to rectangular or flat connectors, such as USB and HDMI connectors.

Figure 9B:
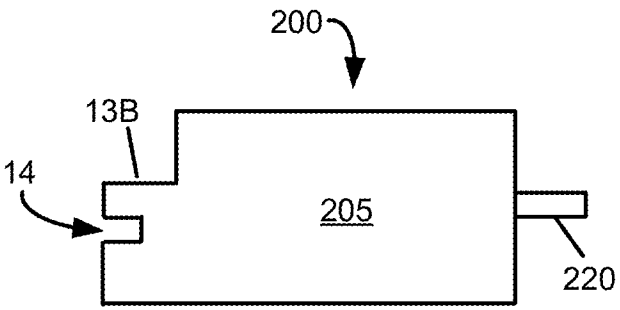
FIGS. 9A and 9B show a rectangular blind-mate connector having an insulated body, sidewalls, and an alignment notch in each sidewall, used in conjunction with a PCB having slots therein.
Figure 9A:
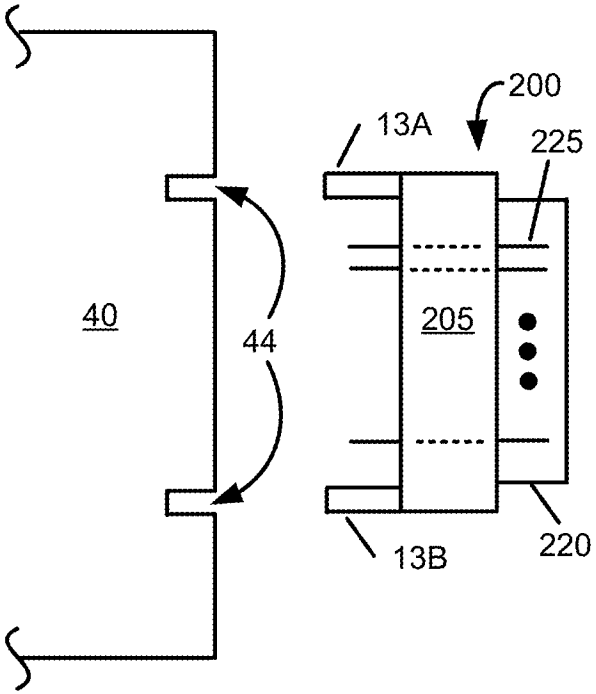

FIGS. 9A and 9B show a rectangular blind-mate connector 200, such as a USB or HDMI connector, having an insulated body 205, sidewalls 13A, 13B, and an alignment notch 14 in each sidewall 13, used in conjunction with a PCB 40 having slots 44 therein. Each alignment notch 14 (or 24 of FIG. 4) engages a corresponding slot 44 in the PCB 40. If the connector 200 is a plug it will also have an insulated tongue 220 extending from the body 205, with contacts 225 thereon. If the connector 200 is a receptacle then tongue 220 will not extend from the body 205, and the contacts 225 will generally be hidden within the body 205.

Figure 10B:
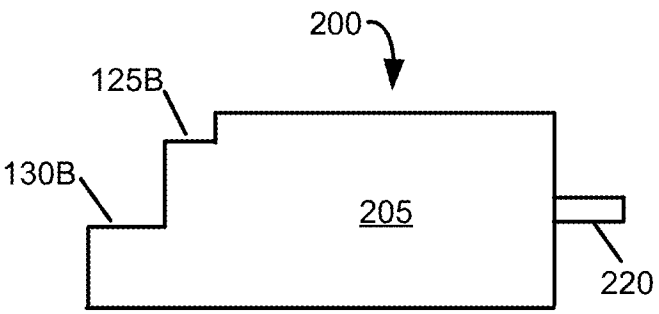
FIGS. 10A and 10B show a rectangular blind-mate connector having an insulated body, alignment tabs, and sidewalls, used in conjunction with a PCB having slots therein.
Figure 10A:
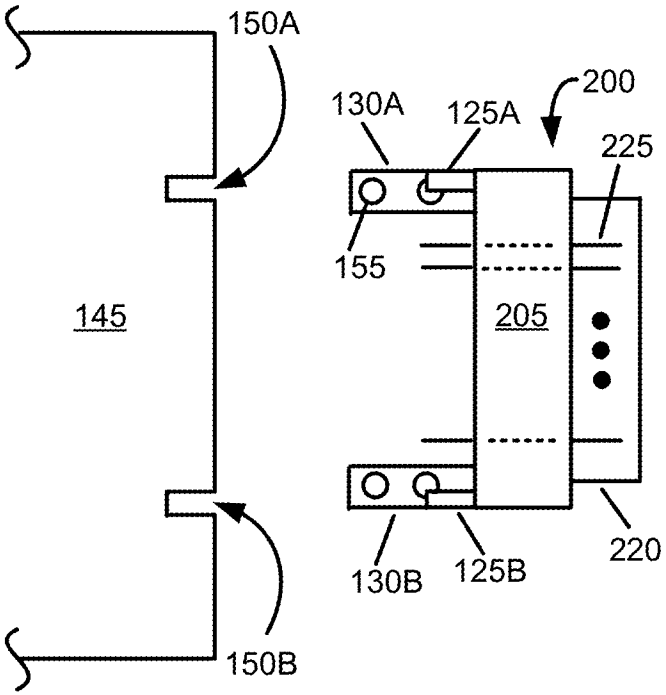

FIGS. 10A and 10B show a rectangular blind-mate connector 200, such as a USB or HDMI connector, having an insulated body 205, alignment tabs 125A, 125B, and sidewalls 130A, 130B, used in conjunction with a PCB 40 having slots 150A, 150B therein. Each tab 125 engages a corresponding slot 150 in the PCB 40. If the connector 200 is a plug it will also have an insulated tongue 220 extending from the body 205, with contacts 225 thereon. If the connector 200 is a receptacle then tongue 220 will not extend from the body 205, and the contacts 225 will generally be hidden within the body 205. The sidewalls 130A, 130B may or may not have holes 155 to accommodate the use of a screw 160 to fix the position of the connector on the PCB.

With respect to FIGS. 9A, 9B, 10A, and 10B, the electrical contacts 225 may be on only one side of the tongue 220 or may be on both sides of the tongue 220. Also, when a first blind-mate connector 200, for example, a blind-mate plug on a first PCB 145, is mated with a complementary second blind-mate connector 200, for example, a blind-mate receptacle on a second PCB 145, the electrical contacts 225 of the blind-mate plug are in electrical contact with corresponding electrical contacts 225 of the blind-mate receptacle.

As used herein, "approximately" means within such tolerances that provide the desired result, for example, to allow automated blind-mating to be performed, or to provide strength, rigidity, insulation, etc. For example, if two PCBs each have only a single, large connector thereon, then the dimensional tolerances for the alignment notches and tabs of the connectors 10, 20, 100 with respect to the thickness of the PCBs, the width and length of notches in the PCBs, etc., may be within a first range. If, however, two PCBs each have two, three, four, or more, small (e.g., miniature or subminiature) connectors thereon, then the dimensional tolerances for the alignment notches and tabs of the connectors 10, 20, 100 with respect to the thickness of the PCBs, the width and length of notches in the PCBs, etc., may be smaller than the first range, perhaps significantly so. Also, for example, an insulator 17 may extend from the front end of the base to a desired point inside the barrel, and/or may extend from the back end of the base to a desired distance from the back end of the base, to provide additional rigidity and protection for the center conductor.

In view of the above, the disclosure presented herein also encompasses the subject matter set forth in the following clauses.

Clause 1. A blind-mate connector, comprising: a barrel having a front end and a back end; a base at the back end of the barrel, the base having a front end and back end; a first sidewall extending rearwardly from the back end of the base on a first side, and having a front end at the back end of the base, a back end, and a first alignment notch, the first alignment notch extending only partially from the back end of the first sidewall toward the base; a second sidewall extending rearwardly from the back end of the base on a second side, and having a front end at the back end of the base, a back end, and a second alignment notch, the second alignment notch extending only partially from the back end of the second sidewall toward the base; an insulator mounted in the base; and a center conductor extending from near the front end of the barrel, through the insulator, and extending beyond the back end of the base, the center conductor being held by the insulator.

Clause 2. The blind-mate connector of clause 1, wherein the barrel, the base, the first sidewall, and the second sidewall are manufactured as a single component.

Clause 3. The blind-mate connector of any of clauses 1-2, wherein at least one of the first alignment notch or the second alignment notch has a height which is approximately a thickness of a printed circuit board on which the blind-mate connector is to be mounted.

Clause 4. The blind-mate connector of any of clauses 1-3, wherein at least one of the first alignment notch or the second alignment notch has a depth such that the front end of the barrel is approximately at a predetermined distance from an edge of a printed circuit board on which the blind-mate connector is to be mounted.

Clause 5. The blind-mate connector of any of clauses 1-4, wherein the center conductor is a center pin.

Clause 6. The blind-mate connector of any of clauses 1-4, wherein the center conductor is a center contact.

Clause 7. The blind-mate connector of any of clauses 1-6, wherein the blind-mate connector is a blind-mate receptacle.

Clause 8. The blind-mate connector of any of clauses 1-6, wherein the blind-mate connector is a blind-mate plug.

Clause 9. The blind-mate connector of any of clauses 1-8, and further comprising a retaining ring mounted in the barrel and configured to accept and releasably retain a plug inserted into the barrel.

Clause 10. The blind-mate connector of any of clauses 1-9, wherein the insulator extends to approximately the front end of the barrel.

Clause 11. A blind-mate connector, comprising: a barrel having a front end and a back end; a base at the back end of the barrel, the base having a front end and back end; a first tab extending rearwardly from the back end on a first side; a second tab extending rearwardly from the back end on a second side; a first sidewall extending rearwardly from the back end of the base at a first corner, the first tab being above the first sidewall; a second sidewall extending rearwardly from the back end of the base at a second corner, the second tab being above the second sidewall; an insulator mounted in the base; and a center conductor extending from near the front end of the barrel, through the insulator, and extending beyond the back end of the base, the center conductor being held by the insulator.

Clause 12. The blind-mate connector of clause 11, wherein the barrel, the base, the first tab, the second tab, the first sidewall, and the second sidewall are manufactured as a single component.

Clause 13. The blind-mate connector of any of clauses 11-12, wherein the barrel is threaded.

Clause 14. The blind-mate connector of any of clauses 11-13, wherein the center conductor is a center pin.

Clause 15. The blind-mate connector of any of clauses 11-13, wherein the center conductor is a center contact.

Clause 16. The blind-mate connector of any of clauses 11-15, wherein the blind-mate connector is a blind-mate receptacle.

Clause 17. The blind-mate connector of any of clauses 11-15, wherein the blind-mate connector is a blind-mate plug.

Clause 18. The blind-mate connector of any of clauses 11-17, wherein the insulator extends to approximately the front end of the barrel.

Clause 19. The blind-mate connector of any of clauses 11-18, wherein at least one of the first tab or the second tab has a depth such that the front end of the barrel is at a predetermined distance from an edge of a printed circuit board on which the blind-mate connector is to be mounted.

Clause 20. The blind-mate connector of any of clauses 11-19, wherein at least one of the first tab or the second tab has a width which is approximately a width of a slot on a printed circuit board on which the blind-mate connector is to be mounted.

Clause 21. A blind-mate connector, comprising: an insulated body having a front end and a back end; a first sidewall extending rearwardly from the back end of the body on a first side, and having a front end at the back end of the body, a back end, and a first alignment notch, the first alignment notch extending only partially from the back end of the first sidewall toward the body; a second sidewall extending rearwardly from the back end of the body on a second side, and having a front end at the back end of the body, a back end, and a second alignment notch, the second alignment notch extending only partially from the back end of the second sidewall toward the body; an insulated tongue mounted in the base; and a plurality of electrical contacts on the insulated tongue.

Clause 22. The blind-mate connector of clause 21, wherein the insulated body, the first sidewall, and the second sidewall are manufactured as a single component.

Clause 23. The blind-mate connector of any of clauses 21-23, wherein at least one of the first alignment notch or the second alignment notch has a height which is approximately a thickness of a printed circuit board on which the blind-mate connector is to be mounted.

Clause 24. The blind-mate connector of any of clauses 21-23, wherein at least one of the first alignment notch or the second alignment notch has a depth such that the front end of the blind-mate connector is approximately at a predetermined distance from an edge of a printed circuit board on which the blind-mate connector is to be mounted.

Clause 25. The blind-mate connector of any of clauses 21-24, wherein the insulated tongue extends forward of the body.

Clause 26. The blind-mate connector of any of clauses 21-25, wherein the blind-mate connector is a blind-mate receptacle.

Clause 27. The blind-mate connector of any of clauses 21-25, wherein the blind-mate connector is a blind-mate plug.

Clause 28. A blind-mate connector, comprising: an insulated body having a front end and a back end; a first tab extending rearwardly from the back end on a first side; a second tab extending rearwardly from the back end on a second side; a first sidewall extending rearwardly from the back end at a first corner, the first tab being above the first sidewall; a second sidewall extending rearwardly from the back end at a second corner, the second tab being above the second sidewall; an insulated tongue mounted in the base; and a plurality of electrical contacts on the insulated tongue.

Clause 29. The blind-mate connector of clause 28, wherein the insulated body, the first tab, the second tab, the first sidewall, and the second sidewall are manufactured as a single component.

Clause 30. The blind-mate connector of any of clauses 28-29, wherein at least one of the first tab or the second tab has a depth such that the front end of the blind-mate connector is at a predetermined distance from an edge of a printed circuit board on which the blind-mate connector is to be mounted.

Clause 31. The blind-mate connector of any of clauses 28-30, wherein at least one of the first tab or the second tab has a width which is approximately a width of a slot on a printed circuit board on which the blind-mate connector is to be mounted.

Clause 32. The blind-mate connector of any of clauses 28-31, wherein the blind-mate connector is a blind-mate receptacle.

Clause 33. The blind-mate connector of any of clauses 28-32, wherein the blind-mate connector is a blind-mate plug.

Technologies for construction of edge mount connectors useful for blind-mating by machines have been disclosed herein. Although the subject matter presented herein has been described in language specific to structural features and construction, it is to be understood that the description above is provided by way of illustration or example only, and should not be construed as limiting. Rather, the specific features and construction are disclosed as example forms of implementing the claims and various modifications and changes can be made to the implementations described herein while still being within the true spirit and scope of the claims. Further, it should be appreciated that the above-described subject matter can be applied to other types of blind-mate connectors. Therefore, the subject matter defined in the appended claims is not necessarily limited to the specific features and construction described herein.

I claim:

1. A blind-mate connector for use with a printed circuit board, comprising:

a barrel having a front end and a back end;

a base at the back end of the barrel, the base having a front end and back end;

a first sidewall extending rearwardly from the back end of the base on a first side, and having a front end at the back end of the base, a back end, and a first alignment notch, the first alignment notch extending only partially from the back end of the first sidewall toward the base, the first alignment notch being configured to mate with a first slot on the printed circuit board;

a second sidewall extending rearwardly from the back end of the base on a second side, and having a front end at the back end of the base, a back end, and a second alignment notch, the second alignment notch extending only partially from the back end of the second sidewall toward the base, the second alignment notch being configured to mate with a second slot on the printed circuit board;

an insulator mounted in the base; and a center conductor extending from near the front end of the barrel, through the insulator, and extending beyond the back end of the base, the center conductor being held by the insulator;

wherein the first alignment notch and the second alignment notch accurately position the blind-mate connector on the printed circuit board.

2. The blind-mate connector of claim 1, wherein the barrel, the base, the first sidewall, and the second sidewall are manufactured as a single component.

3. The blind-mate connector of claim 1, wherein at least one of the first alignment notch or the second alignment notch has a height which is approximately equal to a thickness of a printed circuit board on which the blind-mate connector is to be mounted.

4. The blind-mate connector of claim 1, wherein at least one of the first alignment notch or the second alignment notch has a depth such that the front end of the barrel is approximately at a predetermined distance from an edge of a printed circuit board on which the blind-mate connector is to be mounted.

5. The blind-mate connector of claim 1, and further comprising a retaining ring mounted in the barrel and configured to accept and releasably retain a plug inserted into the barrel.

6. The blind-mate connector of claim 1, wherein the center conductor is a center pin.

7. The blind-mate connector of claim 1, wherein the center conductor is a center contact.

8. The blind-mate connector of claim 1, wherein the blind-mate connector is a blind-mate receptacle.

9. The blind-mate connector of claim 1, wherein the blind-mate connector is a blind-mate plug.

10. The blind-mate connector of claim 1, wherein the insulator extends to approximately the front end of the barrel.

11. The blind-mate connector of claim 1, wherein the barrel is threaded.

12. The blind-mate connector of claim 1, wherein the barrel, base, first sidewall, and second sidewall are unitary.

13. The blind-mate connector of claim 1, wherein the barrel, base, first sidewall, and second sidewall are made of a conductive material.

* * * * *